US010400526B2

(12) United States Patent
Nelson

(10) Patent No.: US 10,400,526 B2
(45) Date of Patent: Sep. 3, 2019

(54) ELASTOMERIC CENTRALIZER BASE FOR ROCK DRILLING SYSTEM

(71) Applicant: 1311854 ONTARIO LIMITED, Elliot Lake (CA)

(72) Inventor: Yves Nelson, Algoma Mills (CA)

(73) Assignee: 1311854 ONTARIO LIMITED, Elliot Lake (CA)

( * ) Notice: Subject to any disclaimer, the term of this patent is extended or adjusted under 35 U.S.C. 154(b) by 467 days.

(21) Appl. No.: 14/698,512

(22) Filed: Apr. 28, 2015

(65) Prior Publication Data

US 2016/0319614 A1 Nov. 3, 2016

(51) Int. Cl.
*E21B 19/24* (2006.01)
*E21B 7/02* (2006.01)

(52) U.S. Cl.
CPC ..... *E21B 19/24* (2013.01); *E21B 7/025* (2013.01)

(58) Field of Classification Search
CPC ..... E21D 20/003; E21D 21/00; E21B 19/24; E21B 7/025; E21B 36/003; E21B 7/02
See application file for complete search history.

(56) References Cited

U.S. PATENT DOCUMENTS 3,967,686 A * 7/1976 Fogelstrom ..... E21B 19/24 173/184
3,995,700 A 12/1976 Mayer et al.
4,182,424 A * 1/1980 Prebensen ..... B23Q 1/76 175/210
4,222,445 A * 9/1980 Vadetsky ..... E21B 4/003 175/106
4,822,230 A * 4/1989 Slettedal ..... E21B 19/155 175/85
4,890,680 A * 1/1990 Porsfeld ..... E21B 7/025 173/185
4,944,075 A * 7/1990 Hogan ..... E05B 73/0017 24/704.1
5,785,168 A * 7/1998 Beall, Jr. ..... B65G 35/063 104/166
6,129,159 A * 10/2000 Scott ..... E21B 7/24 173/49
6,189,753 B1 * 2/2001 Kalhok ..... B63B 25/28 114/343

(Continued)

FOREIGN PATENT DOCUMENTS

CA 2792592 C * 4/2015 ..... E21D 20/003

OTHER PUBLICATIONS

Office Action dated Oct. 27, 2016 on corresponding Canadian patent application No. 2,889,565, 3 pages.

*Primary Examiner* — Giovanna C Wright
*Assistant Examiner* — Yanick A Akaragwe
(74) *Attorney, Agent, or Firm* — Faegre Baker Daniels LLP

(57) ABSTRACT

A rock drilling system comprising a rock drill adapted to hold a drill steel to which a drill bit is connected, a drill feed rail for slidably supporting a drill feed that displaces the rock drill along the drill feed rail, a stinger-supported centralizer assembly for centralizing the drill steel, wherein the stinger-supported centralizer assembly has a centralizer base made of an elastomeric material, and a travelling cradle centralizer assembly slidable over the drill feed rail for centralizing the drill steel, wherein the travelling cradle centralizer assembly has a cradle made of an elastomeric material.

18 Claims, 6 Drawing Sheets

(56) References Cited

U.S. PATENT DOCUMENTS

| | | | | |
|---|---|---|---|---|
| 7,644,782 | B1 * | 1/2010 | Coogan | E21B 7/022 173/1 |
| 8,242,928 | B2 * | 8/2012 | Prammer | E21B 17/003 340/853.7 |
| 9,466,896 | B2 * | 10/2016 | Harmason | H01R 4/70 |
| 2008/0169113 | A1 * | 7/2008 | Rubie | E21B 7/025 173/141 |
| 2010/0059281 | A1 * | 3/2010 | Murray | E21B 7/025 175/122 |
| 2011/0248092 | A1 * | 10/2011 | Nelson | E21B 7/025 238/127 |
| 2011/0297446 | A1 * | 12/2011 | Connell | E21B 19/24 175/195 |
| 2014/0112724 | A1 * | 4/2014 | Nelson | E21D 20/00 405/259.1 |
| 2014/0294514 | A1 * | 10/2014 | Nelson | E02D 3/00 405/259.1 |
| 2014/0374168 | A1 * | 12/2014 | Michael | E21B 17/07 175/320 |
| 2015/0292326 | A1 * | 10/2015 | Nelson | E21D 20/003 405/259.1 |
| 2015/0300170 | A1 * | 10/2015 | Nelson | E21D 20/003 405/259.1 |

* cited by examiner

ELASTOMERIC CENTRALIZER BASE FOR ROCK DRILLING SYSTEM

CROSS-REFERENCE TO RELATED APPLICATION

This application is related to Canadian Patent Application No. 2,889,565, filed concurrently on Apr. 28, 2015, entitled "ELASTOMERIC CENTRALIZER BASE FOR ROCK DRILLING" and assigned to the assignee of the present application, the entire disclosure of which is hereby expressly incorporated herein by reference.

TECHNICAL FIELD

The present invention relates generally to mining equipment and, in particular, to jumbo drilling (i.e. production drilling) and rock bolting, i.e. rock drilling for installing rock bolts as ground support in an underground mine.

BACKGROUND

In a mine, ground support, e.g. rock bolts and screening, is used to prevent rock falls. Several different types of rock bolts may be used but all require that holes be drilled in the rock first. This is done with equipment known as rock drills or combined drilling-bolting systems. These are typically mobile units with a bolting head attached. To drill a hole in the rock to install ground support, the bolting head is placed against the rock face (which is called "stinging the face") and then a hole is drilled into the rock. The unit is then indexed to install the rock bolt as ground support.

Conventionally, rock drilling systems employ centralizer assemblies composed of many rigid metal components, which are prone to vibration and which increase the weight of the assembly. These include rigid metal stinger bases, centralizer bases and tops, steel centralizer bushings. The metal components transmit unwanted vibrations from the drill steel to the feed assembly, causing wear and loosening of components.

In view of these shortcomings of the prior art, an improved rock drilling system remains highly desirable.

SUMMARY

In broad terms, the novel rock drilling system includes one or more elastomeric centralizer bases that minimize vibration and weight.

Accordingly, one inventive aspect of the present disclosure is a rock drilling system comprising a rock drill adapted to hold a drill steel to which a drill bit is connected, a drill feed rail for slidably supporting a drill feed that displaces the rock drill along the drill feed rail, a stinger-supported centralizer assembly for centralizing the drill steel, wherein the stinger-supported centralizer assembly has a centralizer base made of an elastomeric material, and a travelling cradle centralizer assembly slidable over the drill feed rail for centralizing the drill steel, wherein the travelling cradle centralizer assembly has a cradle made of an elastomeric material.

Another inventive aspect of the present disclosure is a stinger-mounted centralizer assembly comprising a centralizer base made of an elastomeric material, the base having a lower portion that includes a bore dimensioned to receive a hydraulically extendable stinger rod to which a stinger pad is mounted, wherein the base also has an upper portion that includes a bushing support defining a round trough and a bushing fastened to the bushing support, wherein the bushing is dimensioned to receive a drill steel.

Yet another inventive aspect of the present disclosure is a travelling cradle centralizer assembly comprising a cradle made of an elastomeric material, the cradle being slidable over a feed rail, a base mounted on the cradle, the base having an upper portion that includes a bushing support defining a round trough, and a bushing fastened to the bushing support, wherein the bushing is dimensioned to receive a drill steel.

This summary is provided to highlight certain significant inventive aspects but is not intended to be an exhaustive or limiting definition of all inventive aspects of the disclosure. Other inventive aspects may be disclosed in the detailed description and drawings.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals. It should furthermore be noted that the drawings are not necessarily to scale.

DETAILED DESCRIPTION

Figure 1:
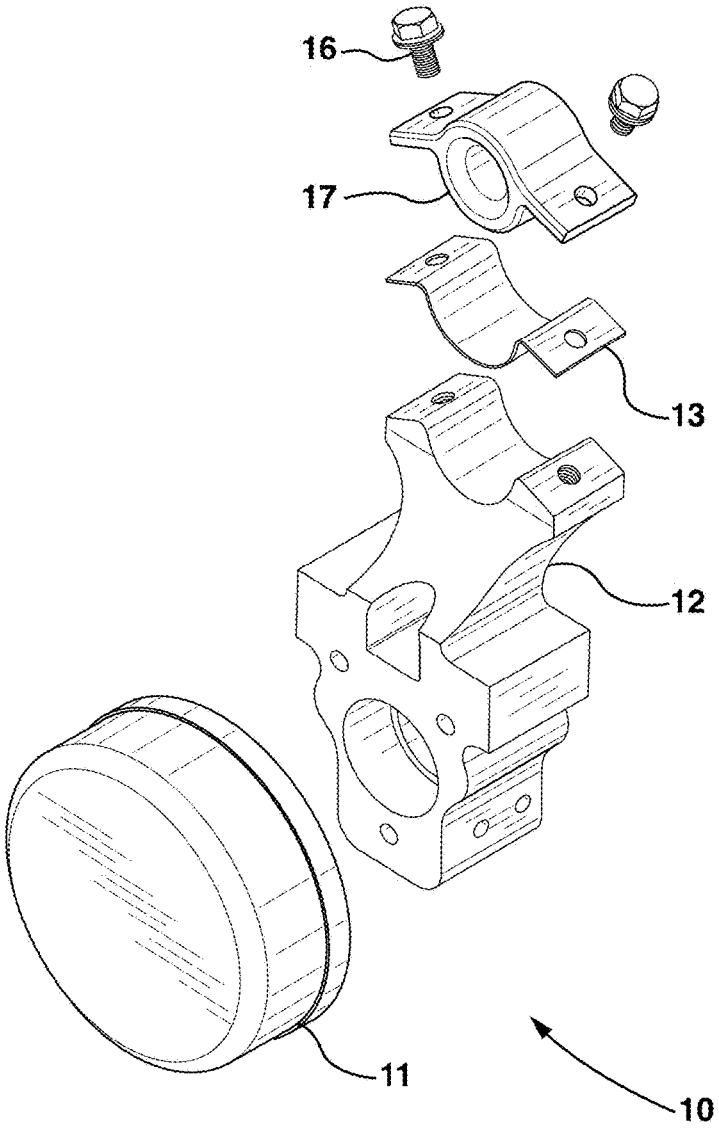
FIG. 1 is an exploded view of a stinger assembly in accordance with an embodiment of the present invention.

In general, the embodiments of the present invention provide a novel rock drilling system and method. The system and method utilize elastomeric centralizer assemblies. Elastomeric assemblies reduce the amount of vibration that travels from the drill steel to the drill feed assembly, thereby reducing wear on the drill feed assembly. In one set of embodiments, an elastomeric centralizer assembly is mounted in a stationary position on the stinger to support a forward portion of the drill string. In another set of embodiments, an elastomeric travelling cradle centralizer assembly is designed to slide over a feed rail, i.e. a drill feed rail of a rock drilling system. In one particular implementation, the centralizer assemblies are made of urethane although these assemblies may be made of any other equivalent or suitable elastomeric material having similar mechanical properties.

Replacing existing rigid metallic components of a centralizer assembly with an elastomeric material attenuates the vibrations that propagate from the drill steel to the feed assembly, thereby reducing wear on the feed components. This new elastomeric design also reduces the number of parts as well as the weight of the assembly. A lighter assembly requires less motive power and thus consumes less energy.

In the embodiments depicted by way of example in FIGS. 1-4, a stinger-mounted centralizer assembly 10 has a centralizer base 12 made entirely of elastomeric material, e.g. urethane or equivalent. In the embodiment depicted by way of example in FIG. 1, the stinger-mounted elastomeric centralizer base is moulded or cast as one integral elastomeric part. This differs from a conventional, fully metal centralizer assembly. The latter would typically include two separate metal parts, namely a metal stinger base and a separate metal centralizer base bolted thereto. In this embodiment, however, the stinger base and the centralizer base are amalgamated together as a single elastomeric component, i.e. made of an elastomer as a single cast or moulded elastomeric part. A heat guard 13 (or heat shield) is optionally attached to the top of the elastomeric centralizer base 12. The optional heat shield, made of a heat-insulating material, shields heat caused by friction between the drill steel and the centralizer bushing from conducting to the elastomeric centralizer base.

A centralizer bushing 17 is attached via fasteners 16 to the optional heat guard 13 (or is attached directly to the base 12 if no heat guard is desired). The bushing 17 remains steel (or other suitable metal or metal alloy). In a variant, the heat guard and bushing may be a single component.

Figure 2:
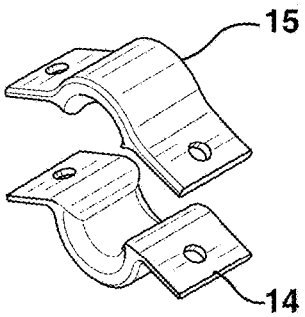
FIG. 2 is a perspective view of an optional two-piece centralizer bushing.

FIG. 2 shows an alternate bushing composed of a bottom bushing half 14 and a top bushing half 15.

In the embodiment illustrated in FIG. 1, the stinger pad 11 is a separate elastomeric component that is attached to the forward end of the stinger and moves relative to the centralizer base. The stinger pad and centralizer base may be made of the same material or different materials.

Figure 3:
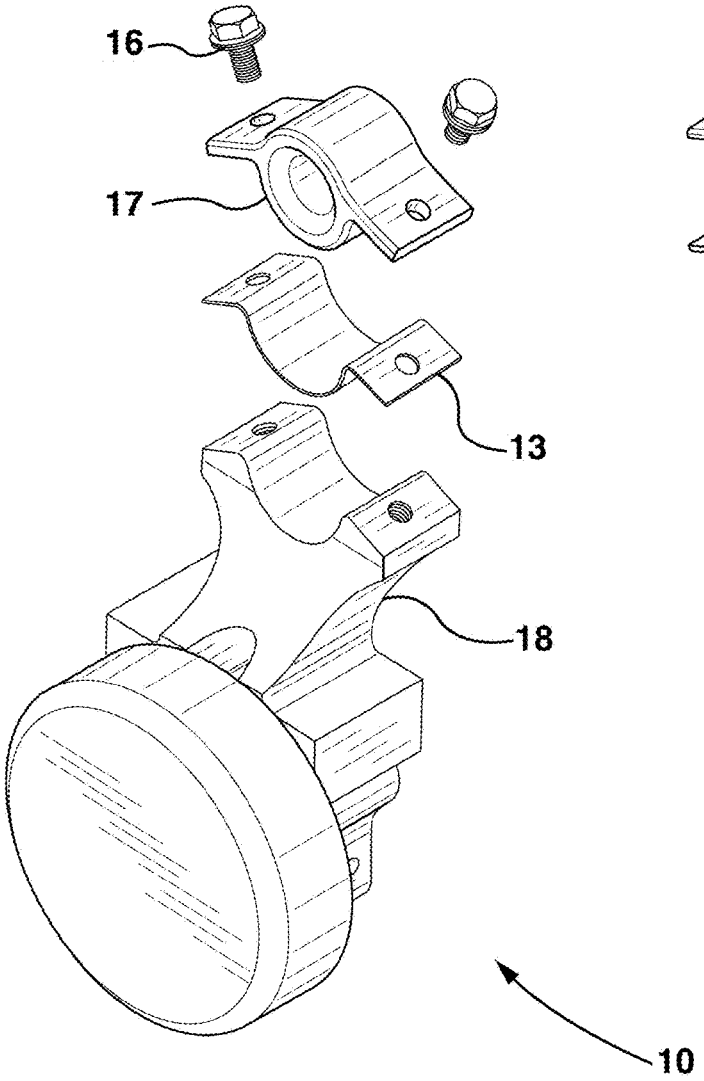
FIG. 3 is an exploded view of a stinger assembly in accordance with another embodiment of the present invention.
Figure 4:
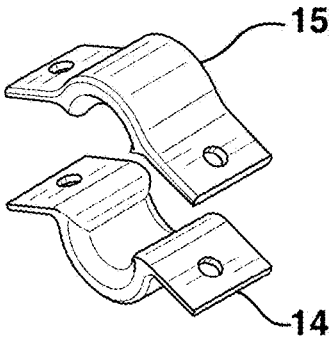
FIG. 4 is a perspective view of an optional two-piece centralizer bushing.

In the embodiment depicted by way of example in FIG. 3, the stinger-mounted elastomeric centralizer assembly 10 incorporates the stinger pad as an integral part of the centralizer base 18. In other words, the pad is cast or moulded as part of the base 18. The heat guard 13 and bushing 17 are mounted to the centralizer base in the same manner as described above with reference to the embodiment of FIG. 1. Accordingly, the elastomeric base 18 is an amalgamation of a stinger base, a centralizer base and a stinger pad which would, in a conventional design, be three separate metal components fastened together to form an assembly. FIG. 4, like FIG. 2, shows an alternate bushing composed of the bottom bushing half 14 and the top bushing half 15. In FIG. 3, the stinger pad is integral (i.e. cast, moulded or formed as a single elastomeric component) so that the base moves with the stinger when the stinger and pad are extended. In contrast, the base 12 of FIG. 1 does not move with the stinger pad when the stinger is extended.

In the embodiments depicted by way of example in FIGS. 5-8, a travelling cradle centralizer assembly 20 has an elastomeric centralizer base that is made of an elastomeric material. The base may be an integrated base and cradle that are formed by casting or moulding a single elastomeric part or it may be composed of two separate parts (i.e. an elastomeric cradle and a separate base that may be either metal or elastomer).

Figure 5:
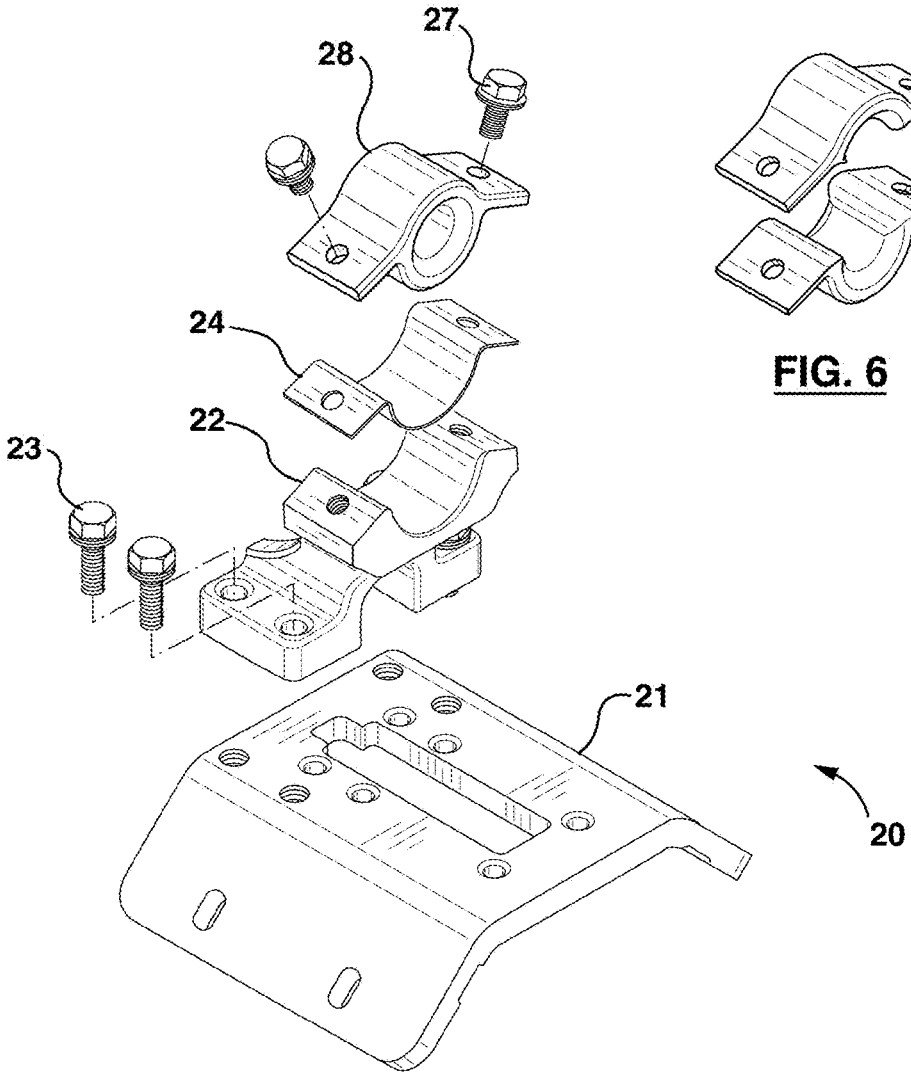
FIG. 5 is an exploded view of a travelling centralizer cradle assembly in accordance with an embodiment of the present invention.
Figure 6:
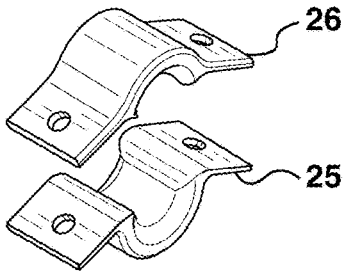
FIG. 6 is a perspective view of an optional two-piece centralizer bushing.

In the embodiment shown by way of example in FIG. 5, the assembly includes an elastomeric cradle 21 to which a base 22 (or bushing support member) is fastened by bolts or other fasteners 23. The base 22 may be made of steel or an elastomeric material or a combination thereof. An optional heat guard 24 (heat shield) may be mounted as shown between the base 22 and the bushing 28. The bushing 28 remains steel (or any other equivalent metal or metal alloy) and is fastened by fasteners 27. FIG. 6, like FIG. 2, shows an alternate bushing composed of the bottom bushing half 25 and the top bushing half 26.

Figure 8:
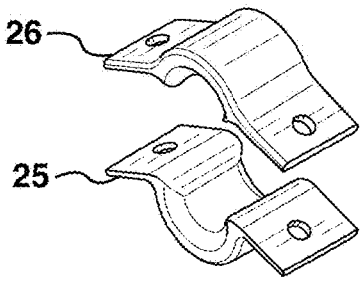
FIG. 8 is a perspective view of an optional two-piece centralizer bushing.
Figure 7:
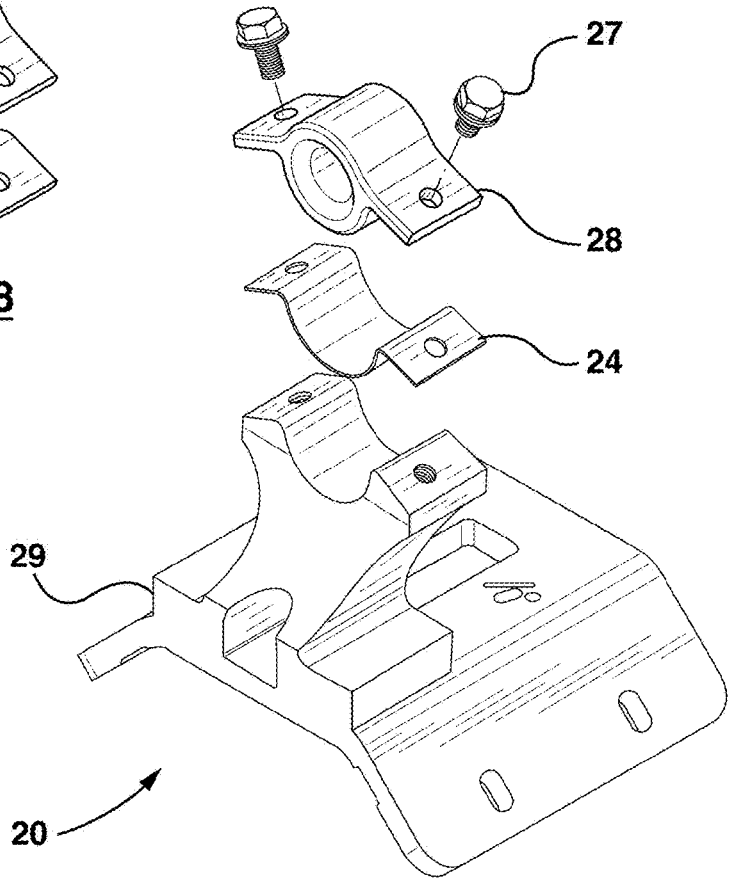
FIG. 7 is an exploded view of a travelling centralizer cradle assembly in accordance with another embodiment of the present invention.

In the embodiment shown by way of example in FIG. 7, the assembly has a fully elastomeric centralizer base 29 that is formed by casting or moulding the base and cradle as a single part. For the sake of greater clarity, the base in FIG. 7 is meant to include the integrated cradle. In other words, two parts (the travelling centralizer cradle and the centralizer base) that would conventionally be metal and bolted together are, in this embodiment, amalgamated together as a single integral elastomeric component. An optional heat guard 24 is fastened as shown. The centralizer bushing 28 remains steel (or any other equivalent metal or metal alloy) and is fastened by fasteners 27. FIG. 8, like FIG. 6, shows an alternate bushing composed of the bottom bushing half 25 and the top bushing half 26.

The elastomeric centralizer assemblies, which may be made of urethane, may be manufactured using casting or moulding techniques that are known in the art.

The elastomeric centralizer base and cradle depicted by way of example in the figures are composed of an amalgamation of parts that are made of one or more vibration-attenuating elastomeric materials. In addition to vibration attenuation, the elastomeric assembly reduces the number of parts required to perform the drill-centralizing function. The use of lightweight elastomeric materials also reduces the overall weight of the assembly. The elastomeric centralizer bases furthermore eliminate the need for a rigid metallic centralizer cap by directly fastening the steel centralizer bushing to the elastomeric centralizer base. This also reduces the number of components and the weight of the assembly.

Figure 9:
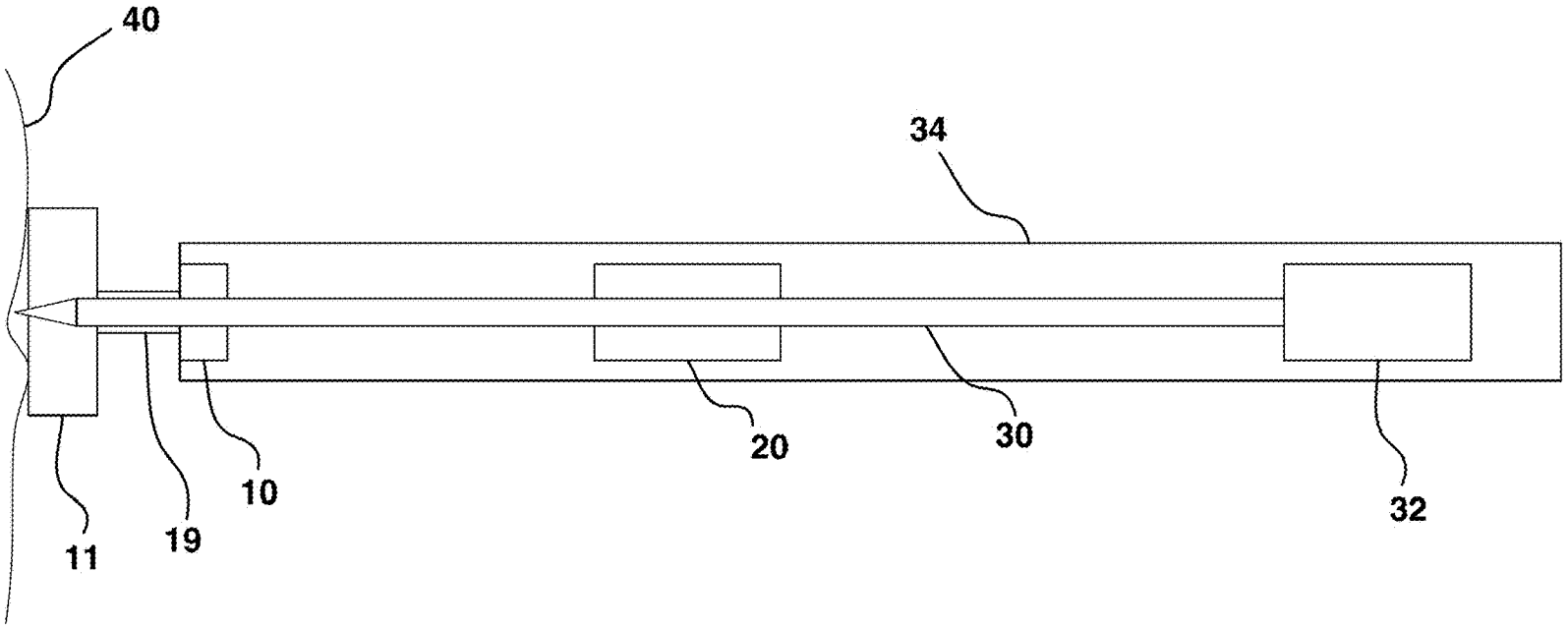
FIG. 9 is a schematic top view of a rock drilling system.

FIG. 9 depicts in schematic form a rock drilling system that includes a drill string 30, a drill feed 32, and a drill feed rail 34 over which the drill feed slides to advance toward, or to withdraw from, a rock face 40 of a rock formation that is to be drilled for the purposes of subsequently installing a rock bolt as ground support. As shown schematically in FIG. 9, the stinger pad 11 is mounted at a forward end of a hydraulically extendable stinger rod 19 which extends through a stinger channel in the stinger and centralizer base assembly 12. The stinger extends to push the stinger pad against the rock face 40 to thereby stabilize the rock drilling system the during drilling operation. The drill string 30 is centralized by both the stinger-mounted centralizer assembly 10 and the travelling cradle centralizer 20. The latter component is rail-mounted on the drill feed rail to slide over the drill feed rail. The drill feed may also slide to advance over the drill feed rail. Once the hole is drilled, the drill feed retracts the drill string. The rock drilling system may be part of a combined drilling and bolting system, also known as a drilling/bolting jumbo, rock bolter or drilling/bolting rig. In such as a system, a bolter feed is indexed into position (i.e. alignment with the hole that has been drilled) while the drill feed is indexed out of position. With the bolter aligned, the bolt can be driven into the hole using a hydraulically powered bolting feed. The hole may also be cemented in some embodiments. The bolt may also carry a washer-type plate in some embodiments. The drilling-bolting cycle is then repeated at various locations at the rock face where ground support is to be installed.

It will be appreciated that the rock drilling system could utilize the elastomeric base in only the travelling cradle or only in the stinger-mounted centralizer although best vibration-attenuation results and weight savings will be obtained when both centralizer bases are elastomeric. The concept of elastomeric bases may be applied to centralizers on the bolting feed as well as the drilling feed although it most useful on the drilling feed because of the higher vibrations encountered in drilling.

Figure 10:
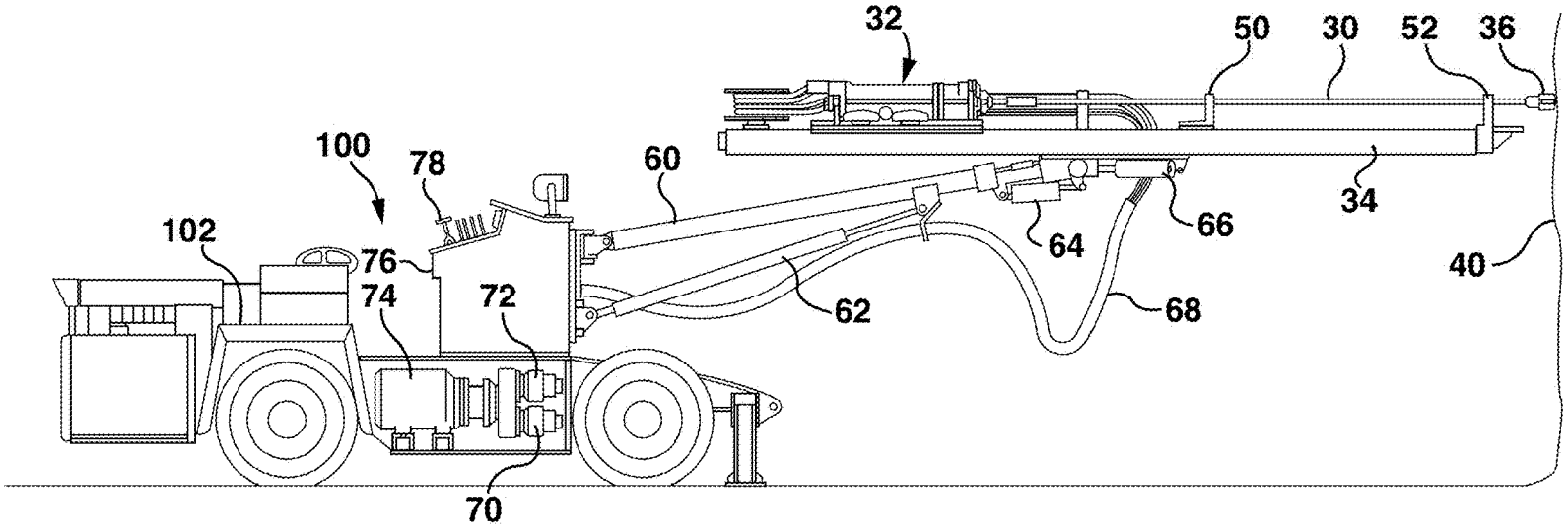
FIG. 10 is a side view of a drill rig that may incorporate one or more elastomeric centralizer bases.

The inventive concept of an elastomeric centralizer assembly may be applied to other types of drilling equipment, drilling jumbos, or hydraulic rock drill systems. For example, a simple hydraulic percussive rock drill system disclosed in U.S. Pat. No. 3,995,700 (Mayer et al) may incorporate an elastomeric centralizer assembly in accordance with another embodiment. The rock drill system (or "drill rig") of U.S. Pat. No. 3,995,700 is depicted in FIG. 10 and generally designated by reference numeral 100. The drill rig has a frame or undercarriage 102. The centralizers 50, 52 (or "guides"), which centralize (guide) the drill steel 30, may be may made of elastomeric material to minimize vibration and weight. The drill steel is driven forward by the drill feed 32 over a drill feed rail 34. At the forward end of the drill steel is a drill bit 36. The drill feed rail is supported by a movable boom 60 positioned by actuating various linear actuators 62, 64 and 66. The drill is hydraulically powered by hydraulic supply hose 68. First and second pumps 70, 72, which are driven by an electric motor 74, supply fluid pressure to the drill feed and actuators, respectively. The drill feed may be controlled and operated from a control station 76 having a pressure-adjusting control knob or any other lever, switch, toggle or input device. The concept of elastomeric centralizers may be applied to this type of drill rig, which is presented as another example of a rock drilling system that may benefit from vibration-reducing elastomeric centralizers. It will be appreciated that the concept of elastomeric centralizers may be applied to any other rock drilling system where the drill string is guided by one or more centralizers. The elastomeric centralizers may be used on a rock bolter or in other applications such as jumbo drilling (i.e. production drilling).

It is to be understood that the singular forms "a", "an" and "the" include plural referents unless the context clearly dictates otherwise. Thus, for example, reference to "a device" includes reference to one or more of such devices, i.e. that there is at least one device. The terms "comprising", "having", "including" and "containing" are to be construed as open-ended terms (i.e., meaning "including, but not limited to,") unless otherwise noted. All methods described herein can be performed in any suitable order unless otherwise indicated herein or otherwise clearly contradicted by context. The use of examples or exemplary language (e.g., "such as") is intended merely to better illustrate or describe embodiments of the invention and is not intended to limit the scope of the invention unless otherwise claimed.

The present invention has been described in terms of specific embodiments, examples, implementations and configurations which are intended to be exemplary or illustrative only. Other variants, modifications, refinements and applications of this innovative technology will become readily apparent to those of ordinary skill in the art who have had the benefit of reading this disclosure. Such variants, modifications, refinements and applications fall within the ambit and scope of the present invention. Accordingly, the scope of the exclusive right sought by the Applicant for the present invention is intended to be limited solely by the appended claims and their legal equivalents.

The invention claimed is:

1. A rock drilling system comprising:

a rock drill adapted to hold a drill steel to which a drill bit is connected;

a drill feed rail for slidably supporting a drill feed that displaces the rock drill along the drill feed rail;

a stinger-supported centralizer assembly for centralizing the drill steel, wherein the stinger-supported centralizer assembly has a centralizer base made of an elastomeric material; and a travelling cradle centralizer assembly slidable over the drill feed rail for centralizing the drill steel, wherein the travelling cradle centralizer assembly has a cradle made of an elastomeric material.

2. The system as claimed in claim 1 wherein the centralizer base of the stinger-supported centralizer assembly includes an integrally formed stinger pad.

3. The system as claimed in claim 2 wherein the travelling cradle centralizer assembly comprises an elastomeric base integrally formed with the cradle.

4. The system as claimed in claim 1 wherein the travelling cradle centralizer assembly comprises an elastomeric base integrally formed with the cradle.

5. The system as claimed in claim 1 further comprising a heat guard made of a heat-insulating material fastened to an upper portion of the centralizer base of the stinger-supported centralizer assembly.

6. The system as claimed in claim 5 further comprising a bushing fastened to the centralizer base with the heat guard fastened between the bushing and the centralizer base.

7. The system as claimed in claim 1 wherein the elastomeric material of both the centralizer base and the cradle is urethane.

8. A stinger-mounted centralizer assembly comprising:

a stinger pad;

a centralizer base made of an elastomeric material, the base having a lower portion that includes a bore fully surrounded by the lower portion and dimensioned to receive a hydraulically extendable stinger rod to which the stinger pad is mounted, wherein the base also has an upper portion that includes a bushing support defining an upwardly facing round trough; and a bushing supported by the rough trough and fastened to the bushing support, wherein the bushing is dimensioned to receive a drill steel.

9. The stinger-mounted centralizer assembly as claimed in claim 8 further comprising a heat guard made of a heat-insulating material fastened between the bushing and the bushing support.

10. The stinger-mounted centralizer assembly as claimed in claim 8 wherein the stinger pad is movable relative to the base.

11. The stinger-mounted centralizer assembly as claimed in claim 8 wherein the stinger pad is integrally formed with the base whereby the base moves with the pad.

12. A travelling cradle centralizer assembly comprising:

a cradle made of an elastomeric material, the cradle being slidable over a feed rail;

a base mounted on the cradle, the base having an upper portion that includes a bushing support defining a round trough;

a bushing fastened to the bushing support, wherein the bushing is dimensioned to receive a drill steel.

13. The travelling cradle assembly as claimed in claim 12 wherein the base is fastened to the cradle.

14. The travelling cradle assembly as claimed in claim 12 wherein the base is integrally formed with the cradle.

15. The travelling cradle assembly as claimed in claim 14 wherein the elastomeric material is urethane.

16. The travelling cradle assembly as claimed in claim 15 further comprising a heat guard made of a heat-insulating material fastened between the bushing and the bushing support.

17. The travelling cradle assembly as claimed in claim 12 further comprising a heat guard made of a heat-insulating material fastened between the bushing and the bushing support.

18. The travelling cradle assembly as claimed in claim 12 wherein the elastomeric material is urethane.

* * * * *